US011295711B2

(12) United States Patent
Rabe et al.

(10) Patent No.: US 11,295,711 B2
(45) Date of Patent: Apr. 5, 2022

(54) PERCUSSION INSTRUMENT WITH AT LEAST TWO TONE BARS

(71) Applicant: SONOR GmbH, Bad Berleburg (DE)

(72) Inventors: Philipp Rabe, Edertal-Wellen (DE); Knut Hoyer, Villingen-Schwenningen (DE); Judit Angster, Stuttgart (DE); András Miklós, Stuttgart (DE)

(73) Assignee: SONOR GmbH, Bad Berleburg (DE)

( * ) Notice: Subject to any disclaimer, the term of this patent is extended or adjusted under 35 U.S.C. 154(b) by 0 days.

(21) Appl. No.: 17/247,631

(22) Filed: Dec. 18, 2020

(65) Prior Publication Data

US 2021/0193092 A1 Jun. 24, 2021

(30) Foreign Application Priority Data

Dec. 20, 2019 (DE) ..... 10 2019 135 565.6

(51) Int. Cl.

| | |
|---|---|
| ***G10D 13/08*** | (2020.01) |
| ***G10D 13/10*** | (2020.01) |
| ***G10D 13/24*** | (2020.01) |

(52) U.S. Cl.

CPC ..... *G10D 13/25* (2020.02); *G10D 13/08* (2013.01); *G10D 13/24* (2020.02)

(58) Field of Classification Search

CPC ..... G10D 13/08; G10D 13/25; G10D 13/24
See application file for complete search history.

(56) References Cited

U.S. PATENT DOCUMENTS

| | | | | | |
|---|---|---|---|---|---|
| 1,010,926 | A | | 12/1911 | Lawrence | |
| 1,237,873 | A | | 8/1917 | Deagan | |
| 1,291,778 | A | | 1/1919 | Deagan | |
| 1,293,723 | A | * | 2/1919 | Deagan | G10D 13/08 84/410 |
| 1,304,435 | A | * | 5/1919 | Winterhoff | G10D 13/08 84/410 |
| 1,369,268 | A | * | 2/1921 | Deagan | G10D 13/08 84/410 |
| 1,484,655 | A | | 2/1924 | Kohler | |
| 1,935,566 | A | * | 11/1933 | Greenleaf | G10D 13/08 84/410 |
| 2,020,150 | A | | 11/1935 | Ludwig | |
| 2,287,138 | A | | 6/1942 | Elmer | |
| D158,632 | S | | 5/1950 | Zimmerman | |
| 2,704,482 | A | | 3/1955 | Sas | |
| 2,799,198 | A | | 7/1957 | Harry | |

(Continued)

FOREIGN PATENT DOCUMENTS

| | | |
|---|---|---|
| DE | 7346111 U | 4/1974 |
| DE | 1803789 B2 | 6/1975 |

(Continued)

OTHER PUBLICATIONS

Co-prending U.S. Appl. No. 17/019,496.
Co-prending U.S. Appl. No. 17/019,592.

*Primary Examiner* — Robert W Horn
(74) *Attorney, Agent, or Firm* — Smartpat PLC

(57) ABSTRACT

The invention relates to a percussion instrument having at least two tone bars, each with an upper and lower side and at least one resonance box with at least one resonance body, wherein the resonance body consists of a neck and a resonance chamber.

20 Claims, 2 Drawing Sheets

(56) References Cited

U.S. PATENT DOCUMENTS

| | | | | | |
|---|---|---|---|---|---|
| 2,971,424 | A * | 2/1961 | Kent | G10D 13/08 84/404 |
| 3,174,382 | A | 3/1965 | Hans et al. | |
| 3,483,786 | A | 12/1969 | Heninger et al. | |
| 3,595,119 | A * | 7/1971 | Kuijpers | G10D 13/08 84/403 |
| 3,705,527 | A | 12/1972 | Burnham | |
| 3,858,477 | A | 1/1975 | Kawakami | |
| 3,961,553 | A | 6/1976 | Schorr | |
| D318,305 | S | 7/1991 | Takahashi et al. | |
| 5,479,843 | A | 1/1996 | Yanagisawa | |
| 5,686,679 | A | 11/1997 | Nakano et al. | |
| 6,696,628 | B2 | 2/2004 | Yoshida | |
| D491,215 | S | 6/2004 | Tanaka | |
| 7,732,691 | B2 * | 6/2010 | Stevens | G10D 13/08 84/403 |
| 2021/0082377 | A1 | 3/2021 | Rabe et al. | |
| 2021/0082378 | A1 | 3/2021 | Rabe et al. | |
| 2021/0193092 | A1 * | 6/2021 | Rabe | G10D 13/08 |

FOREIGN PATENT DOCUMENTS

| | | | |
|---|---|---|---|
| DE | 9108858 | U1 | 10/1991 |
| DE | 9116075 | U1 | 2/1992 |
| DE | 19707358 | C2 | 2/2002 |
| DE | 10357326 | A1 | 6/2005 |
| DE | 202005017628 | U1 | 6/2006 |
| DE | 102005015812 | | 7/2006 |
| DE | 102013101694 | | 6/2014 |
| EP | 1872091 | A1 | 1/2008 |
| EP | 2770497 | A2 | 8/2014 |
| GB | 2564438 | A | 1/2019 |
| NL | 7605085 | A | 11/1977 |

* cited by examiner

PERCUSSION INSTRUMENT WITH AT LEAST TWO TONE BARS

CROSS-REFERENCE TO RELATED APPLICATION

This application claims priority to German patent application DE 10 2019 135 565.6, filed Dec. 20, 2019, the contents of which are incorporated by reference.

TECHNICAL FIELD

The disclosure relates to a percussion instrument having at least two tone bars.

BACKGROUND

Percussion instruments with one or more tone bars are known from, for example, DE 7 346 111 U1, NL 76 05 085 or EP 1 872 091 B1. Depending on a pitch and an associated specific frequency band of the tone bar, a resonance box and a resonance body assigned to the tone bar should have a design optimized for the specific frequency band of the tone bar in order to achieve ideal sound characteristics of the percussion instrument.

With the known types of percussion instruments, this leads to large dimensions of the percussion instruments, in particular for low tones of the tone bars and/or for percussion instruments with multiple tone bars. This can be particularly disadvantageous when the percussion instrument is transported or when multiple percussion instruments are stored in, for example, a school, since storage space is typically limited.

In order to reduce the size of percussion instruments, compromises are generally made in the design of the resonance box and/or the resonance body at the expense of sound quality. By adjusting the resonance box and/or the resonance body to the desired outer dimensions of a percussion instrument, this usually has a negative effect on the sound characteristics of the percussion instrument. This is in particular true if particularly compact percussion instruments are to be produced.

SUMMARY

The object of the disclosure is therefore to provide a compact percussion instrument, wherein the resonance bodies are still adjusted to the tone bars.

The object is solved by a percussion instrument with at least two tone bars. A resonance body of the percussion instrument is assigned to at least one tone bar and the resonance body is sealed off from the tone bar by a cover plate pierced with at least one opening. The lower side of the tone bar has a gap d from the upper side of the cover plate. The resonance body has at least one sound hole oriented towards the tone bar, at least one neck and at least one resonance chamber. The neck is located between the sound hole and the resonance chamber. The neck connects, in a communicative manner, the sound hole and the resonance chamber. The sound hole and the opening in the cover plate partially or completely overlap. An x-, y- and z-direction form a Cartesian coordinate system, wherein the x-direction points in the direction of the length of the percussion instrument, the y-direction points in the direction of the width of the percussion instrument and the z-direction points in the direction of the height of the percussion instrument.

At least two resonance bodies are arranged in the resonance box, in whole or in part, next to each other with respect to the y-direction and/or the z-direction of the percussion instrument, wherein the at least two resonance bodies in the resonance box is assigned to tone bars lined up along the x-direction.

The position of the resonance body in the resonance box is only indirectly linked to the position of the associated tone bar. This makes it possible to make use of areas of the resonance box that were previously not accessible to a resonance body. This allows the volume of the resonance box to be reduced without reducing the volume of the resonance body.

At least two openings are preferably arranged in a one-part or multi-part cover plate of the percussion instrument, in whole or in part, side by side or offset in relation to the y-direction of the percussion instrument. The openings in the cover plate can be at least partially sealed, preferably with a plug or a slider. Compared to the usual construction methods, this gives rise to the advantage that there are more degrees of freedom with regard to the positioning of the resonance bodies and possible exchange of the tone bar. Given that the openings can be at least partially sealed, preferably with a plug or a slider, the instrument can be easily adjusted to a changed tone bar without having to change the cover plate.

The gap d of the tone bar to the surface of the cover plate is preferably ≤60 mm, even more preferably ≤40 mm, very preferably ≤20 mm. This ensures that a tone from a tone bar is transmitted to the resonance body as well as possible. In the case of larger deviations, the sound characteristics of the percussion instrument may deteriorate.

The volume of at least one resonance chamber $V_{Rr}$ of the resonance body is preferably formed to be rectangular-shaped, cube-shaped, prism-shaped, cylinder-shaped, sphere-shaped, cone-shaped and/or ellipsoid-shaped. The volume of at least one resonance chamber $V_{Rr}$ of the resonance body is preferably formed by at least two volumes that are connected and/or volumes that intersect with each other. This makes it possible for resonance chambers to have complex geometries and undercuts, without any disadvantage for the sound characteristics of the instrument. When determining the structural shape of a resonance chamber, it should be noted that the number of volume-forming surfaces is as small as possible, since the probability of unwanted resonance frequencies occurring increases with an increasing number of surfaces in a resonance chamber.

The volume of the resonance chamber $V_{Rr}$ is preferably ≥1 $cm^3$ and ≤30,000 $cm^3$, more preferably ≥3 $cm^3$ and ≤25,000 $cm^3$, even more preferably ≥5 $cm^3$ and ≤22,000 $cm^3$. Within this volume range, the volume of the resonance chamber is ideally adjusted to the tone bars of the most common percussion instruments. The ideal volumes of the resonance chambers can then be accommodated in the resonance box by different geometric shapes.

It is preferred if the length L of the neck is ≥0.5 mm and ≤300 mm, more preferably ≥1 mm and ≤200 mm, even more preferably ≥1.5 mm and ≤100 mm, and the sound-conducting cross-sectional area S of the neck is preferably ≥0.008 $cm^2$ and ≤80 $cm^2$, more preferably ≥0.03 $cm^2$ and ≤30 $cm^2$, even more preferably ≥0.12 $cm^2$ and ≤12.5 $cm^2$. An additional preferred characteristic is if the dimensions L, S of the neck are formed from the dimensions of a neck $L_H$, $S_H$ of the resonance body and the dimensions ($L_D$, $S_D$) of the opening of the cover plate. A neck dimensioned in this manner enables ideal sound transmission between the tone bar and the resonance chamber over all the tonal ranges normally played, while at the same time enables the greatest possible variability in the manufacture of the individual components of the percussion instrument.

It is particularly advantageous if a tone bar is assigned to a resonance body. In such a case, fewer compromises have to be made with regard to the design of the volumes of the resonance chamber and/or the dimensions of the neck.

Furthermore, it is preferable if the resonance box forms the housing of the percussion instrument. This saves one assembly during production and allows the manufacture of particularly inexpensive instruments.

In a preferred design of a percussion instrument, the resonance box and the associated resonance bodies are formed as one component. Ideally, the material used for the one-piece resonance box should be an injection-moldable material, wood or a composite material, in particular fiber composite material. This type of design is preferable if particularly inexpensive instruments are to be produced or if an exchange of the tone bar with a change in the tone of the tone bar is not intended.

Furthermore, a preferred design of a percussion instrument is one in which at least one resonance chamber in the resonance box is interchangeable and preferably the resonance box and/or resonance body is made of an injection-moldable material, wood or a composite material, in particular fiber composite material. This embodiment is preferred for high-quality instruments, with which an exchange of the tone bar with a change of the tone of the tone bar is necessary or desired. The fact that the resonance body can be replaced means that a resonance body can be adjusted to the changed tone of the tone bar.

The inner surface of the neck is lined with a sound-absorbing material, preferably a textile. This can influence the intensity of the sound transmission.

Furthermore, it is preferred if the dimensions L, S of the neck can be changed by an interchangeable insert. This also allows the resonance body to be adjusted to a changed tone bar. Thereby, it is preferred if the interchangeable insert is made of a sound-absorbing material and/or the surface of the interchangeable insert is completely or partially coated with a sound-absorbing material, preferably a textile. This also gives rise to advantages with respect to sound transmission.

The sound characteristics of a percussion instrument are further improved, particularly if openings in the cover plate are close together, by the fact that the surface oriented towards the tone bars has an elevation between two adjacent openings in the cover plate, preferably an elevation in the form of a rib. This prevents the vibration from jumping over to the adjacent opening. The elevation or rib, as the case may be, is preferably fastened to the surface of the cover plate as an additional component. Depending on the number and position of the openings in the cover plate, it is also preferable if the elevation or rib, as the case may be, runs continuously across the entire instrument. This reduces the number of necessary ribs and thus the number of components. Depending on the frequencies or tone bars, as the case may be, the rib is made of a hard material with a hardness of ≥12 N/mm$^2$ Brinell or ≤39 Schore D, as the case may be, preferably wood, metal or plastic. Alternatively, the bar is made of a soft material with a hardness of ≥90 Shore A, preferably of plastic, in particular rubber or silicone.

DETAILED DESCRIPTION

Figure 1:
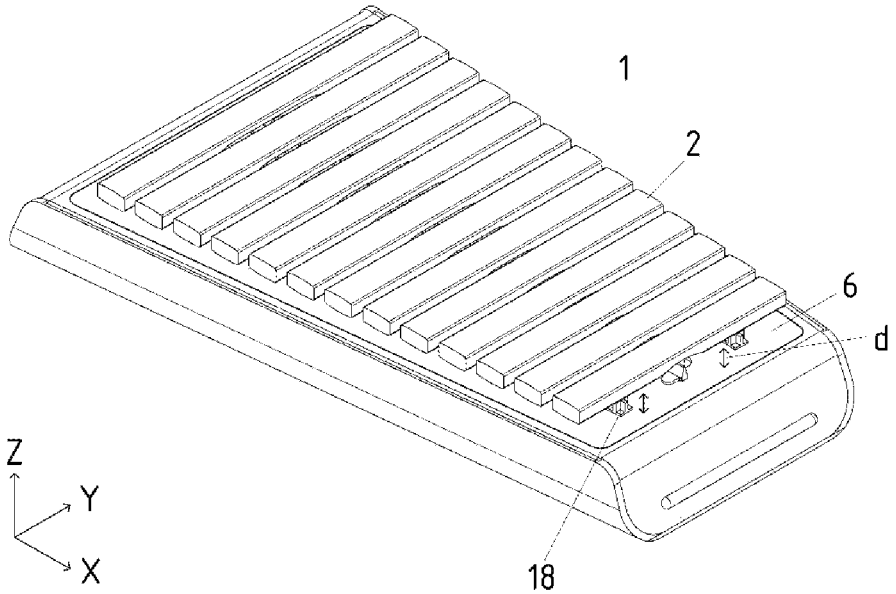
FIG. 1 shows an exemplary percussion instrument.

FIG. 1 shows an exemplary percussion instrument 1. The percussion instrument 1 has multiple tone bars 2, which are arranged one after the other in the x-direction. The tone bars 2 are fastened to the upper side of the cover plate 6 by two connecting elements 18. Due to the height of the connecting element 18, each tone bar 2 has an assigned gap d from the cover plate 6, wherein the cover plate 6 seals the resonance bodies 4 with respect to the tone bar 2. The resonance box 3 is located within a frame 15 of the percussion instrument 1.

Figure 2:
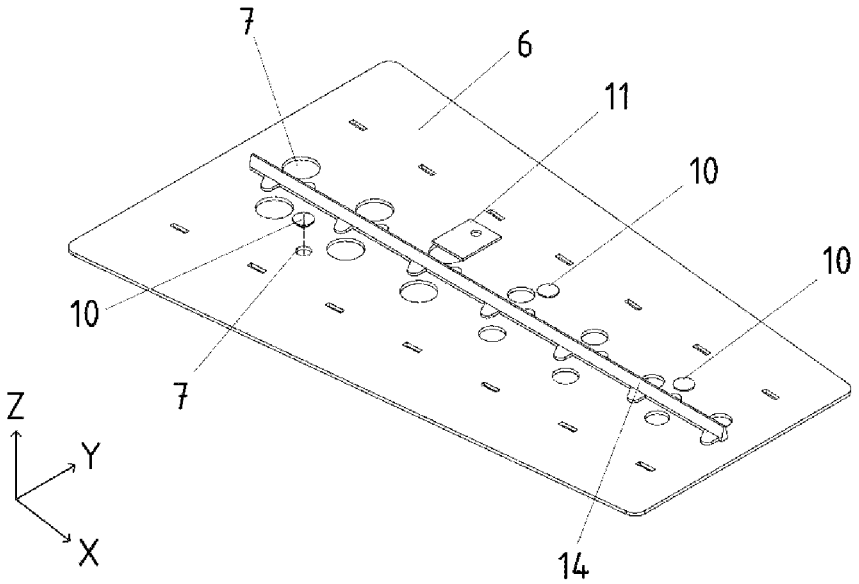
FIG. 2 shows a cover plate with rib.

FIG. 2 shows a cover plate 6 of a percussion instrument 1 with multiple openings 7. Some of the openings 7 are sealed with plugs 10. Furthermore, the cover plate 6 has sliders 11 that are connected to the cover plate 6 in a movable manner. Through a corresponding positioning the slider 11 opposite the opening 7 in the cover plate 6, the cross-sectional area S of the sound hole 8 can be reduced. An additionally attached rib 14 runs along the central axis of the cover plate 6 and separates adjacent openings 7 from each other.

Figure 3:
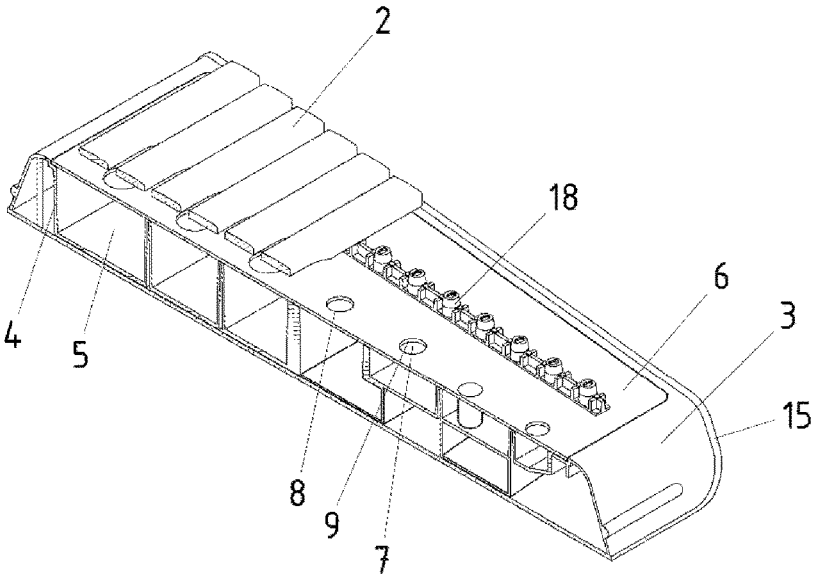
FIG. 3 is a sectional view through a percussion instrument with multiple resonance bodies.

FIG. 3 shows a section through a percussion instrument 1. Each tone bar 2 is assigned a resonance body 4 with a resonance chamber 5. Depending on the assigned tone bar 2, the volume of the resonance chamber 5 and/or the dimensions L, H of the neck 9 change.

Figure 4A:
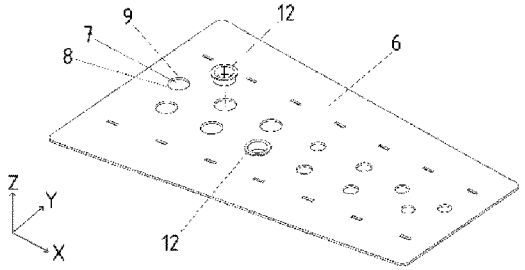
FIG. 4*a* is a perspective view of an interchangeable insert inserted into an opening in a cover plate.
Figure 4B:
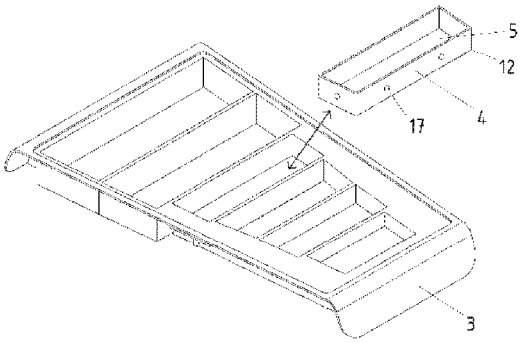
FIG. 4*b* is a perspective view of an alternative interchangeable insert.

FIGS. 4 *a*) and *b*) show possibilities for influencing the sound characteristics of the percussion instrument 1. In FIG. 4 *a*), an interchangeable insert 12 is inserted into an opening in the cover plate 6. This reduces the cross-sectional area S of the neck 9 compared to the initial area and also extends the neck 9 by the height of the collar 16. FIG. 4 *b*) shows an interchangeable insert 12 belonging to the percussion instrument 1 with which the volume of a resonance chamber 5 can be reduced. The interchangeable insert 12 has flexible spacers 17 on its outer side. These prevent the interchangeable insert 12 from slipping within the resonance chamber 5 and reduce the transmission of disrupting vibrations of the interchangeable insert 12 to the resonance body 4 and/or the resonance box 3.

REFERENCE NUMBERS

1 Percussion instrument
2 Tone bar
3 Resonance box
4 Resonance body
5 Resonance chamber
6 Cover plate
7 Opening in the cover plate
8 Sound hole
9 Neck
10 Plug
11 Slider
12 Interchangeable insert
13 Elevation
14 Bar
15 Frame
16 Collar 17 Spacer
18 Connecting element
d Gap from the lower side of the tone bar to the upper side of the cover plate
$V_{Rr}$ Volume of the resonance chamber
L Length of the neck
S Opening area of the neck
$L_H$ Length of the neck of the resonance body
$S_H$ Opening area of the neck of the resonance body
$L_D$ Length of the neck of the cover plate
$S_D$ Opening area of the neck of the cover plate

What is claimed is:

1. A percussion instrument (1), comprising:
at least two tone bars (2), each having an upper side and lower side; and
at least one resonance box (3) with at least two resonance bodies (4),
wherein at least one resonance body (4) of the at least two resonance bodies (4) is assigned to at least one tone bar (2) of the at least two tone bars (2), and
wherein the at least one resonance body (4) is sealed with respect to the at least one tone bar (2) by a cover plate (6) pierced with at least one opening (7), and
wherein the lower side of the at least one tone bar (2) has a gap (d) from an upper side of the cover plate (6); and
wherein the at least one resonance body (4) comprises
at least one sound hole (8) oriented towards the at least one tone bar (2),
at least one neck (9), and
at least one resonance chamber (5),
wherein the at least one neck (9) is located between the at least one sound hole (8) and the at least one resonance chamber (5); and
wherein the at least one neck (9) connects, in a communicative manner, the at least one sound hole (8) with the at least one resonance chamber (5); and
wherein the at least one sound hole (8) and the at least one opening (7) in the cover plate (6) at least partially overlap; and
wherein an x-direction, a y-direction, and a z-direction form a Cartesian coordinate system, wherein the x-direction points in a direction of a length of the percussion instrument (1), the y-direction points in a direction of a width of the percussion instrument (1) and the z-direction points in a direction of a height of the percussion instrument (1); and
wherein the at least two resonance bodies (4) in the at least one resonance box (3) are arranged, in whole or in part, next to each other with respect to the y-direction and/or the z-direction of the percussion instrument (1), and
wherein the at least two resonance bodies (4) in the resonance box (3) are assigned to the at least two tone bars (2) lined up in the x-direction.

2. The percussion instrument according to claim 1,
wherein at least two openings (7) in a one-part or multi-part cover plate (6) of the percussion instrument (1) are arranged, in whole or in part, side by side of offset in relation to the y-direction of the percussion instrument (1).

3. The percussion instrument according to claim 1,
wherein the opening (7) in the cover plate (6) can be at least partially sealed by a plug (9) or a slider (10).

4. The percussion instrument according to claim 1,
wherein the gap (d) of the tone bar (2) to the surface of the cover plate (6) is ≤60 mm.

5. The percussion instrument according to claim 1,
wherein a volume ($V_{Rr}$) of the at least one resonance chamber (5) of the at least one resonance body (4) is formed to be rectangular-shaped, cube-shaped, prism-shaped, cylinder-shaped, sphere-shaped, cone-shaped and/or ellipsoid-shaped.

6. The percussion instrument according to claim 5,
wherein the volume ($V_{Rr}$) of at least one resonance chamber (5) of the at least one resonance body (4) is formed by at least two volumes that are connected and/or volumes that intersect with each other.

7. The percussion instrument according to claim 1,
wherein a volume ($V_{Rr}$) of the at least one resonance chamber (5) is ≥1 $cm^3$ and ≤30,000 $cm^3$.

8. The percussion instrument according to claim 1,
wherein a length (L) of the neck (8) is ≥0.5 mm and ≤300 mm, and
wherein a sound-conducting cross-sectional area (S) of the neck is ≥0.008 $cm^2$ and ≤80 $cm^2$.

9. The percussion instrument according to claim 1,
wherein dimensions (L, S) of the neck (8) are formed from dimensions of a neck ($L_H$, $S_H$) of the resonance body (4) and dimensions ($L_D$, $S_D$) of the opening (7) of the cover plate (6).

10. The percussion instrument according to claim 1,
wherein one resonance body (4) of the at least two resonance bodies (4) is assigned to each of the at least two tone bars (2).

11. The percussion instrument according to claim 1,
wherein the at least one resonance box (3) and the at least two resonance bodies (4) are formed as one component.

12. The percussion instrument according to claim 11,
wherein the one component is made of an injection-moldable material, of wood or of a composite material.

13. The percussion instrument according to claim 1,
wherein the at least one resonance chamber (5) in the at least one resonance box (3) is interchangeable.

14. The percussion instrument according to claim 13,
wherein the at least one resonance box (3) and/or the at least one resonance body (4) are made of an injection-moldable material, wood or a composite material.

15. The percussion instrument according to claim 1,
wherein an inner surface of the neck (8) is at least partially lined with a sound-absorbing textile material.

16. The percussion instrument according to claim 1,
wherein dimensions (L, S) of the neck can be changed by an interchangeable insert (12).

17. The percussion instrument according to claim 1,
wherein a surface oriented towards the tone bars (2) has an elevation (13), between two adjacent openings in the cover plate (6).

18. The percussion instrument according to claim 17,
wherein the elevation (13) is fastened as an additional component on the surface of the cover plate (6).

19. The percussion instrument according to claim 17,
wherein the elevation (12) is a rib (13) and runs continuously over the entire cover plate (6) of the percussion instrument (1).

20. The percussion instrument according to claim 17,
wherein the elevation (13) is made of a hard material with a hardness of ≥12 $N/mm^2$ Brinell or ≤39 Shore D, or
the elevation (13) is made of a soft material with a hardness of ≥90 Shore A.

* * * * *